US011821116B2

(12) United States Patent
Gretton et al.

(10) Patent No.: US 11,821,116 B2
(45) Date of Patent: Nov. 21, 2023

(54) ARTICLE OF APPAREL

(71) Applicant: adidas AG, Herzogenaurach (DE)

(72) Inventors: Julie Caroline Gretton, Herzogenaurach (DE); Ya Lun Liu, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 570 days.

(21) Appl. No.: 16/375,402

(22) Filed: Apr. 4, 2019

(65) Prior Publication Data

US 2019/0309450 A1 Oct. 10, 2019

(30) Foreign Application Priority Data

Apr. 5, 2018 (DE) ..... 10 2018 205 136.4

(51) Int. Cl.
*D03D 13/00* (2006.01)
*D03D 1/00* (2006.01)
(Continued)

(52) U.S. Cl.
CPC ..... *D03D 13/008* (2013.01); *A41B 1/00* (2013.01); *A41D 1/02* (2013.01); *A41D 1/04* (2013.01);
(Continued)

(58) Field of Classification Search
CPC ..... D03D 13/008; D03D 1/00; A41B 1/00; A41B 2500/20; A41D 1/02; A41D 1/04;
(Continued)

(56) References Cited

U.S. PATENT DOCUMENTS 4,248,927 A * 2/1981 Liebman ..... B32B 5/06 428/6
6,047,406 A * 4/2000 Dicker ..... A41D 13/0015 2/115
(Continued)

FOREIGN PATENT DOCUMENTS

CN 106661782 A 5/2017
CN 206964084 U 2/2018
(Continued)

OTHER PUBLICATIONS

Extended European Search Report issued in European Patent Application No. 19166689.0, dated Jul. 8, 2019, 7 pages.

*Primary Examiner* — Khoa D Huynh
*Assistant Examiner* — Erick I Lopez
(74) *Attorney, Agent, or Firm* — Sterne, Kessler, Goldstein & Fox P.L.L.C.

(57) ABSTRACT

The present invention concerns an article of apparel including: a first woven area, where the first woven area includes a first weaving density and a first yarn weight per unit length; a second woven area arranged adjacent to the first woven area, where the second woven area includes a second weaving density and a second yarn weight per unit length; and a third woven area arranged adjacent to the second woven area, where the third woven area includes a third weaving density and a third yarn weight per unit length. The second weaving density in the second woven area changes gradually from the first weaving density to the third weaving density and/or the second yarn weight per unit length in the second woven area changes gradually from the first yarn weight per unit length to the third yarn weight per unit length.

19 Claims, 4 Drawing Sheets

Figure 1:
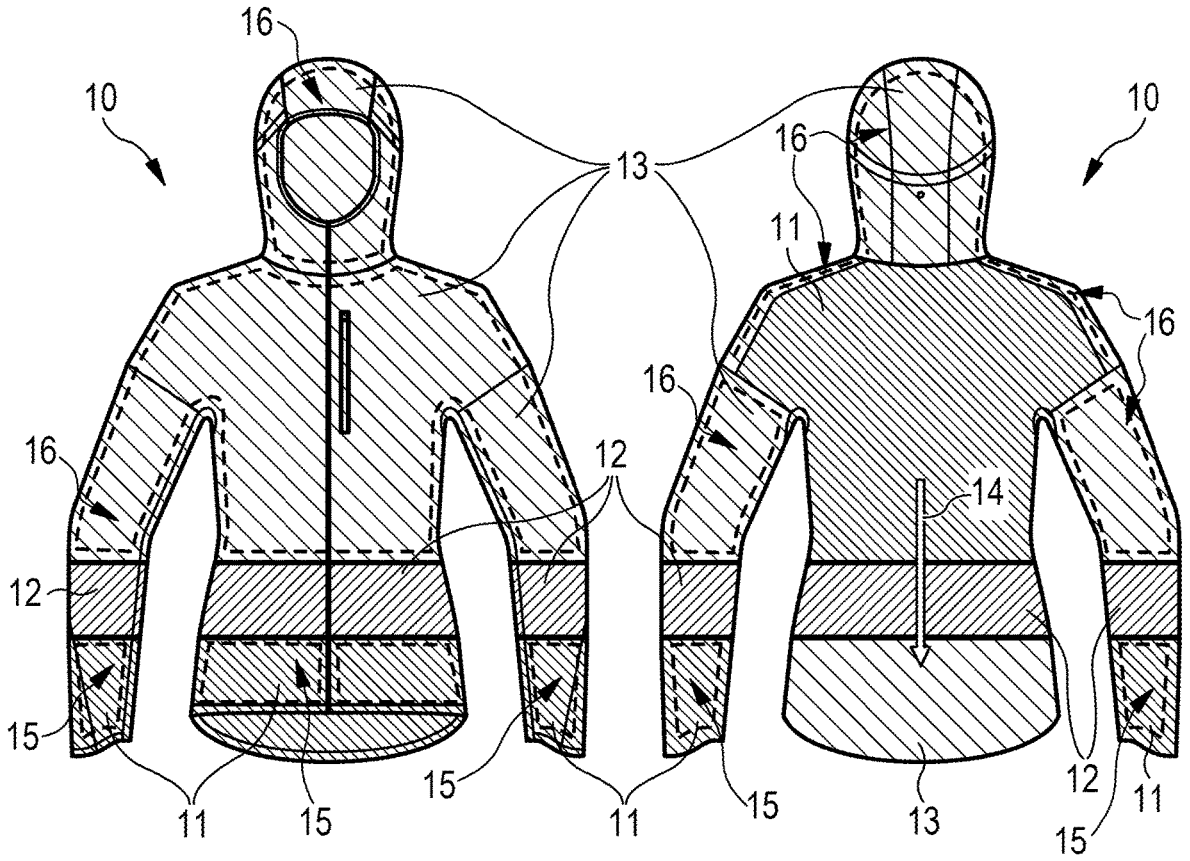

(51) Int. Cl.

| | |
|---|---|
| ***A41D 31/14*** | (2019.01) |
| ***A41B 1/00*** | (2006.01) |
| ***A41D 1/02*** | (2006.01) |
| ***A41D 1/04*** | (2006.01) |
| ***A41D 7/00*** | (2006.01) |
| ***A41D 13/00*** | (2006.01) |

(52) U.S. Cl.
CPC ..... *A41D 7/00* (2013.01); *A41D 13/0015* (2013.01); *D03D 1/00* (2013.01); *A41B 2500/20* (2013.01); *A41D 31/14* (2019.02); *A41D 2500/20* (2013.01); *A41D 2600/10* (2013.01); *A41D 2600/104* (2013.01); *D10B 2501/04* (2013.01)

(58) Field of Classification Search
CPC ..... A41D 7/00; A41D 13/0015; A41D 31/14; A41D 2500/20; A41D 2600/10; D10B 2501/04

See application file for complete search history.

(56) References Cited

U.S. PATENT DOCUMENTS

| | | | | |
|---|---|---|---|---|
| 2005/0204449 | A1* | 9/2005 | Baron | D04B 1/16 2/69 |
| 2005/0246813 | A1* | 11/2005 | Davis | A41D 13/0015 2/69 |
| 2009/0077710 | A1* | 3/2009 | Bay | A41D 3/00 2/87 |
| 2009/0291280 | A1* | 11/2009 | Hartert | D03D 13/008 428/218 |
| 2016/0345641 | A1* | 12/2016 | Aihara | B64C 23/06 |
| 2017/0028669 | A1* | 2/2017 | Regester | A41D 3/00 |
| 2017/0099898 | A1* | 4/2017 | Pezzimenti | A41D 1/08 |
| 2017/0233904 | A1* | 8/2017 | Weening | D03D 15/513 139/420 R |
| 2018/0002842 | A1* | 1/2018 | Steel | D03D 1/0035 |
| 2018/0184730 | A1* | 7/2018 | Autard | A41D 27/04 |
| 2018/0279930 | A1* | 10/2018 | Coppede | D02G 3/441 |

FOREIGN PATENT DOCUMENTS

| | | | |
|---|---|---|---|
| DE | 2 100 576 | A1 | 7/1972 |
| DE | 21 00 576 | A | 7/1972 |
| EP | 0 927 523 | A1 | 7/1999 |
| EP | 2 171 141 | B1 | 7/2010 |
| WO | WO 2015/171363 | A1 | 11/2015 |

* cited by examiner

ARTICLE OF APPAREL

TECHNICAL FIELD

The present invention relates to an improved article of apparel, especially for sports, with properties that are matched to the anatomic and athletic needs of a wearer.

PRIOR ART

An article of apparel can be manufactured from various different materials and using a wide range of techniques in order to try to accommodate the needs of a wearer for a certain application. Weaving is often a preferred method of producing an article of apparel as weaving allows an article of apparel with good tensile strength and abrasion resistance as well as moderate to high wind resistance to be produced. By selecting an appropriate type of yarn, for example a yarn from a particular material over the particular weight per unit length, measured for example in dtex or dernier, it is possible to further engineer the properties of an article of apparel for a certain application. For example, synthetic materials, such as polyester, a popular for sports applications as they have good wicking properties and dry quickly.

However, it is known that there are varying anatomic and athletic requirements on an article of apparel for different parts of the body. These requirements also depend on the type of activity and concern, for example, the air permeability of the fabric of the article of apparel, its thermal insulating properties, as well as its ability to transport moisture. For example, during cycling an athlete may be exposed to strong winds coming from the front leading to wind chill on his front side, while his back would not be exposed to the wind and therefore may get hot and sweaty.

It is known in the prior art to provide an article of apparel with different zones for different anatomic and athletic requirements. However, in the prior art, such an article of apparel comprises separate sheets, which may have different air permeability, thermal insulating properties, or moisture transporting properties. The separate sheets are sewn together at their edges in order to provide the different zones. The stitching areas where the separate sheets are sewn together are uncomfortable, especially if the article of apparel is in close contact with the skin, and may lead to abrasions and sports injuries. Matching the anatomic and athletic requirements of the wearer is also limited by the need to use relatively large sheets for the process to be economical. This contrasts with the anatomic and athletic requirements, which typically vary gradually from one area to another. Moreover, the production of such an article of apparel is complicated by the additional steps required for sewing together the separate sheets. The stitching also adds weight to the article of apparel and is a weak spot for tearing, especially during physical activity.

It is therefore an object of the present invention to provide an improved article of apparel, which offers an improved match for the anatomic and athletic requirements of a wearer, is easier and more economical to produce and more lightweight and robust than an existing article of apparel.

SUMMARY OF THE INVENTION

This object is accomplished by the teachings of the independent claims and in particular by an article of apparel comprising: (a) a first woven area, wherein the first woven area comprises a first weaving density and a first yarn weight per unit length; (b) a second woven area arranged adjacent to the first woven area, wherein the second woven area comprises a second weaving density and a second yarn weight per unit length; and (c) a third woven area arranged adjacent to the second woven area, wherein the third woven area comprises a third weaving density and a third yarn weight per unit length; wherein the second weaving density in the second woven area changes gradually from the first weaving density to the third weaving density; and/or wherein the second yarn weight per unit length in the second woven area changes gradually from the first yarn weight per unit length to the third yarn weight per unit length.

This is to be understood such that (i) the second weaving density in the second woven area changes gradually from the first weaving density to the third weaving density; or (ii) the second yarn weight per unit length in the second woven area changes gradually from the first yarn weight per unit length to the third yarn weight per unit length; or (iii) the second weaving density in the second woven area changes gradually from the first weaving density to the third weaving density and the second yarn weight per unit length in the second woven area changes gradually from the first yarn weight per unit length to the third yarn weight per unit length.

It is to be understood that the second weaving density varies depending on the position within the second woven area and that the first and/or third weaving density may be constant in the first/third woven area, respectively.

The article of apparel may be used for athletic purposes, like sports, however generally the article of apparel may also be for use in leisure or business.

It is to be understood that the second woven area is arranged in-between the first woven area and the third woven area.

Generally, a lower weaving density corresponds to higher air permeability and lower thermal insulation than a higher weaving density. Likewise, a large yarn weight per unit length, measured for example in dtex or dernier, generally corresponds to lower air permeability and better thermal insulation than a small yarn weight per unit length. This comparison assumes, of course, that other parameters are otherwise unchanged.

Weaving density is to be understood as a linear density. For example, the weft density may be measured by a number of picks per unit length, for example picks per centimetre or picks per inch. For example, the warp density may be measured by a number of ends per unit length, for example ends per centimetre or ends per inch. Since weaving naturally involves a discrete number of yarns that are interwoven with each other, the smallest meaningful distance over which weaving density may be measured is the distance between two adjacent yarns, in which case the weaving density would be the inverse of the distance between the two adjacent yarns. This is equally true if the two adjacent yarns are separated along a weft direction and if the two adjacent yarns are separated along a warp direction. It is to be understood that distances are to be determined along a surface of the article of apparel.

Accordingly, the smallest meaningful distance over which a gradient in the linear density may be determined is the distance between three adjacent yarns. However, the smallest meaningful distance over which a gradient in the yarn weight per unit length may be determined is a distance between two adjacent yarns.

It is to be understood that both the weaving density and the yarn weight per unit length may be determined as an average value over an averaging length, wherein the averaging length may be a separation of three adjacent yarns, preferably five adjacent yarns, more preferably ten adjacent yarns, in order to allow an accurate determination.

If the weaving density and the yarn weight per unit length is determined as an average value over an averaging length, the second woven area may be longer in any direction than the averaging length. For example, the second woven area may be twice as long in any direction as the averaging length, preferably five times as long, more preferably ten times as long. This way, an accurately measurable and gradual variation in the properties of the article of apparel, that is clearly perceivable by the wearer, may be achieved.

A gradual change may be a monotonous increase or decrease, which may or may not be linear. A gradual change of the second weaving density in the second woven area from the first weaving density to the third weaving density and/or a gradual change of the second yarn weight per unit length in the second woven area from the first yarn weight per unit length to the third yarn weight per unit length may comprise a change of the second weaving density and/or the second yarn weight per unit length at least once per 100 adjacent yarns, preferably at least once per 50 adjacent yarns, more preferably at least once per 25 adjacent yarns, most preferably at least once per 10 adjacent yarns. The shorter the distance between successive changes, the finer the "granularity" of the gradient and hence the better the matching of gradual changes in the anatomic and athletic requirements.

The second woven area may comprise at least three changes of the second weaving density and/or the second yarn weight per unit length, preferably at least five changes, more preferably at least 10 changes, most preferably at least 20 changes. The greater the number of changes, the finer the "granularity" of the gradient and hence the better the matching of gradual changes in the anatomic and athletic requirements.

The second woven area may be at least 0.5 cm long in any direction along the surface of the article of apparel, preferably 1 cm, more preferably 5 cm, most preferably 10 cm. The inventors found that if the second woven area is too small, it is not possible to ideally match the gradual change of the anatomic and athletic requirements of a wearer.

The first and third woven area may be at least 0.5 cm long in any direction along the surface of the article of apparel, preferably 1 cm, more preferably 5 cm, most preferably 10 cm. The inventors found that the sizes are preferable to ideally match the anatomic and athletic requirements of a wearer.

It is to be understood that the article of apparel may comprise at least one further area that comprises a textile, for example a knitted textile or a non-woven textile, or non-textile material, for example a waterproof sheet made from a synthetic material.

The first woven area, the second woven area, and the third woven area may be connected by weaving and may be part of one unitary woven fabric. Therefore, a stitching may be absent from an interface between the first woven area and the second woven area, and an interface between the second woven area and the third woven area.

It is an advantage of the article of apparel according to the present invention that it does not require the presence of a stitching, for example to sew adjacent sheets with different properties together. A stitching may be perceived as uncomfortable, especially if the article of apparel is in close contact with the skin, and may lead to abrasions and sports injuries. A stitching also adds weight to the article of apparel and is a weak spot for tearing, especially during physical activity.

The first woven area may comprise a first air permeability, the second woven area may comprise a second air permeability, the third woven area may comprise a third air permeability, and the second air permeability in the second woven area may change gradually from the first air permeability to the third air permeability.

The air permeability is to be determined for the woven fabric in the first woven area, the second woven area, and the third woven area, itself, irrespective of any additional layers, such as fillings.

The inventors have found that the air permeability of the article of apparel is particularly important in order to ensure the well-being and comfort of the wearer during physical activity. For example, some areas of the wearer's body may be exposed to strong winds, for example the front of the body during physical activities such as cycling or running, and therefore are ideally covered by an area of the article of apparel with a low air permeability in order to prevent excessive heat loss of the body. Other areas of the body may not be exposed to strong winds, for example the back of the body during physical activity such as cycling or running, and are therefore ideally covered by an area of the article of apparel with a high air permeability in order to ensure sufficient ventilation. Typically, however, there is a gradual change between these two areas. In the given example, this may pertain particularly to the lateral sides of the wearer's body during cycling or running. This gradual change in the requirements is best matched by gradually changing air permeability. It should be understood that this gradual change in requirements may be due to external factors, such as wind from running or cycling in the given example, as well as due to internal anatomic and physiological factors. Some areas of the human body produce more heat and/or sweat than other areas.

The first weaving density may be a first weft density; the second weaving density may be a second weft density; the third weaving density may be a third weft density; and the second weft density in the second woven area may change gradually from the first weft density to the third weft density. In other words, the first, second, and third weaving density may be determined by a first, second, and third number of picks per unit length, for example picks per centimetre or picks per inch, respectively. The inventors have found that it is simpler to gradually change the weft density during weaving than it is to gradually change the warp density during weaving.

Gradually changing the weft density may comprise gradually changing the speed of a take-up roller. The article of apparel may be at least partly produced on a loom. A take-up roller may be any device configured to pull the woven fabric out of the loom. For example, a higher take-up roller speed would decrease the weft density if the time between weft insertions is kept the same. This allows for a simple and effective way of controlling the weft density or weft density gradient without needing to increase the time between weft insertions, which would increase the total weaving time.

A visual analysis system comprising a camera may be used to monitor the weft and/or warp density in real time. For example, a high contrast image can be processed with a computer to obtain the number of weft yarns, or picks per cm. This information may be used to provide direct feedback to adjust the speed of the take-up roller in order to achieve a selected target weft density or weft density gradient.

The article of apparel may further comprise (a) a first insulating layer arranged in the first woven area and (b) a third insulating layer arranged in the third woven area. This way it is possible to enhance a difference in the properties of the article of apparel in the first woven area and the third woven area, for example differences in air permeability, thermal insulation, and moisture transport. The first insulating layer and the third insulating layer may be arranged in a part of the second woven area and a transition between the first insulating layer and the third insulating layer may be arranged in the second woven area.

The first insulating layer may comprise a synthetic filling and the third insulating layer may comprise down feathers. The synthetic filling may comprise a polymer. The synthetic filling may comprise a polymer foam. For example, the polymer may be polyester. The synthetic filling may be sealed even in a woven fabric with a low weaving density, i.e. a woven fabric with a large distance between adjacent weft or warp yarns. A filling comprising down feathers provides excellent thermal insulation and moisture transport properties but typically requires a higher weaving density. This combination of the first and third insulating layer therefore ensures optimal compatibility with the woven fabric in the first woven area and the third woven area. Either or both fillings may be sealed in compartments in order to localize the filling to a certain area of the article of apparel.

Alternatively, the article of apparel may comprise one insulating layer arranged in the first, second, and third woven areas, wherein the insulating layer may comprise a synthetic filling, or a down feather filling, or a mixture thereof, as described herein.

The third weft density may be at least twice as large as the first weft density. The inventors have studied the differences in heat production and perspiration for different parts of the human body and compared these to the different properties, in particular thermal insulation and moisture transport, effected by a different weft density. The inventors have found that in order to accommodate the different requirements of different parts of the human body, the third weft density should be at least twice as large as the first weft density, preferably five times as large, and for some applications preferably at least ten times as large.

Alternatively, or additionally, the third yarn weight per unit length may be at least twice as large as the first yarn weight per unit length. The inventors have found that in order to accommodate the different requirements of different parts of the human body, the third yarn weight per unit length should be at least twice as large as the first yarn weight per unit length, preferably five times as large, and for some applications preferably at least ten times as large.

The first air permeability may be at least twice as large as the third air permeability. The inventors have found that in order to accommodate the different requirements of different parts of the human body particularly concerning ventilation, the first air permeability should be at least twice as large as the third air permeability, preferably five times as large, and for some applications preferably at least ten times as large.

The article of apparel may be a jacket, a shirt, a jersey, a swim suit, or a vest. The anatomic and athletic requirements vary particularly on the upper body and less so on the lower body. Therefore, it is advantageous if the article of apparel is a garment for the upper body. However, alternatively the article of apparel may be a pair of trousers or shorts, or even a shoe, a boot, or a sock.

The third woven area may be arranged in a kidney area. The inventors have found, that a kidney area requires a good level of thermal insulation for comfort and to prevent illness, therefore the third woven area is advantageously arranged in a kidney area.

The third woven area may be arranged in a chest area. The inventors have found, that a chest area requires a good level of thermal insulation and needs to offer a good level of wind resistance for comfort and to prevent illness, therefore the third woven area is advantageously arranged in a chest area.

The first woven area may be arranged in an upper back area. The inventors have found, that an upper back area requires a good level of ventilation and heat transport, i.e. low thermal insulation for comfort and to prevent overheating of an athlete during exercise, for example running or cycling, during which the upper back area is not generally subjected to much air circulation. Therefore, the first woven area is advantageously arranged in an upper back area.

The first woven area may be arranged in a lower front area, in order to facilitate a preferable degree of ventilation for the athlete.

The article of apparel may further comprise at least one yarn, which comprises a meltable component. Preferably, the meltable material melts at a temperature of less than 100° C., more preferably less than 80° C., in order to prevent damage to the other yarns in the component during heating. For example, one or more yarns may be a melt yarn, sometimes also referred to as a fuse yarn. A melt yarn may have a core with a high melting temperature which is coated with a material with a lower melting temperature. A melt yarn allows a simple stabilization and consolidation of the article of apparel, which is particularly useful to stabilize the gradient in weaving density. However, it may also be possible that a gradient in weaving density is maintained merely by the friction between the yarns.

The first woven area may comprise a yarn of a first material, the third woven area may comprise a yarn of a third material, and the first material may be different to the third material. Thus, it is possible to further enhance the differences in the properties between the first woven area and third woven area. It is further possible that the second woven area comprises a yarn of a second material and wherein the second material comprises a blend of the first material and the third material that gradually changes from the first material to third material. Thus, it is possible to also enhance the effect of the gradual change in the properties of the article of apparel in the second woven area.

The invention further concerns a method of producing an article of apparel, comprising: weaving a first woven area with a first weaving density and a first yarn weight per unit length; weaving a second woven area, arranged adjacent to the first woven area, with a second weaving density and a second yarn weight per unit length; and weaving a third woven area, arranged adjacent to the second woven area, with a third weaving density and a third yarn weight per unit length; wherein weaving the second woven area comprises gradually changing the second weaving density from the first weaving density to the third weaving density; and/or wherein weaving the second woven area comprises gradually changing the second yarn weight per unit length from the first yarn weight per unit length to the third yarn weight per unit length.

This is to be understood such that (i) weaving the second woven area comprises gradually changing the second weaving density from the first weaving density to the third weaving density; or (ii) weaving the second woven area comprises gradually changing the second yarn weight per unit length from the first yarn weight per unit length to the third yarn weight per unit length; or (iii) weaving the second woven area comprises gradually changing the second weaving density from the first weaving density to the third weaving density and weaving the second woven area comprises gradually changing the second yarn weight per unit length from the first yarn weight per unit length to the third yarn weight per unit length.

It is to be understood that the second weaving density varies depending on the position within the second woven area and that the first and/or third weaving density may be constant in the first/third woven area, respectively.

The article of apparel may be used for athletic purposes, like sports, however generally the article of apparel may also be for use in leisure or business.

It is to be understood that the second woven area is arranged in-between the first woven area and the third woven area.

The effects of a lower or higher weaving density have been described above. It has also been described above how the weaving density and the yarn weight per unit length and the corresponding gradients are to be measured.

A gradual change may be a monotonous increase or decrease, which may or may not be linear. Gradually changing the second weaving density in the second woven area from the first weaving density to the third weaving density and/or gradually changing the second yarn weight per unit length in the second woven area from the first yarn weight per unit length to the third yarn weight per unit length may comprise changing the second weaving density and/or the second yarn weight per unit length at least once per 100 adjacent yarns, preferably at least once per 50 adjacent yarns, more preferably at least once per 25 adjacent yarns, most preferably at least once per 10 adjacent yarns. The shorter the distance between successive changes, the finer the "granularity" of the gradient and hence the better the matching of gradual changes in the anatomic and athletic requirements.

The second woven area may comprise at least three changes of the second weaving density and/or the second yarn weight per unit length, preferably at least five changes, more preferably at least 10 changes, most preferably at least 20 changes. The greater the number of changes, the finer the "granularity" of the gradient and hence the better the matching of gradual changes in the anatomic and athletic requirements.

The second woven area may be at least 0.5 cm long in any direction along the surface of the article of apparel, preferably 1 cm, more preferably 5 cm, most preferably 10 cm. The inventors found that if the second woven area is too small, it is not possible to ideally match the gradual change of the anatomic and athletic requirements of a wearer.

The first and second woven area may be at least 0.5 cm long in any direction along the surface of the article of apparel, preferably 1 cm, more preferably 5 cm, most preferably 10 cm. The inventors found that the sizes are preferable to ideally match the anatomic and athletic requirements of a wearer.

It is to be understood that the article of apparel may comprise at least one further area that comprises a textile, for example a knitted textile or a non-woven textile, or non-textile material, for example a waterproof sheet made from a synthetic material.

The method of producing an article of apparel may further comprise connecting the first woven area, the second woven area, and the third woven area by weaving such that the first woven area, the second woven area, and the third woven area are part of one unitary woven fabric. In particular, the first woven area, the second woven area, and the third woven area may be integrally woven, directly subsequently to another on the same loom.

It is an advantage of the method of producing an article of apparel according to the present invention that it does not require sewing adjacent sheets with different properties together. A stitching that would result from sewing may be perceived as uncomfortable, especially if the article of apparel is in close contact with the skin, and may lead to abrasions and sports injuries. A stitching also adds weight to the article of apparel and is a weak spot for tearing, especially during physical activity.

The method of producing an article of apparel may further comprise: providing a first air permeability in the first woven area; providing a second air permeability in the second woven area; providing a third air permeability in the third woven area; and gradually changing the second air permeability in the second woven area from the first air permeability to the third air permeability. This is advantageous as described above.

The air permeability is to be determined for the woven fabric in the first woven area, the second woven area, and the third woven area, itself, irrespective of any additional layers, such as fillings.

The first weaving density may be a first weft density; the second weaving density may be a second weft density; the third weaving density may be a third weft density; and weaving the second woven area may comprise weaving with a second weft density that gradually changes from the first weft density to the third weft density.

In other words, the first, second, and third weaving density may be determined by a first, second, and third number of picks per unit length, for example picks per centimetre or picks per inch, respectively. The inventors have found that it is simpler to gradually change the weft density during weaving than it is to gradually change the warp density during weaving.

Gradually changing the weft density may comprise gradually changing the speed of a take-up roller. The method may comprise using a loom. A take-up roller may be any device configured to pull the woven fabric out of the loom. For example, a higher take-up roller speed would decrease the weft density if the time between weft insertions is kept the same. This allows for a simple and effective way of controlling the weft density or weft density gradient without needing to increase the time between weft insertions, which would increase the total weaving time.

A visual analysis system comprising a camera may be used to monitor the weft and/or warp density in real time. For example, a high contrast image can be processed with a computer to obtain the number of weft yarns, or picks per cm. This information may be used to provide direct feedback to adjust the speed of the take-up roller in order to achieve a selected target weft density or weft density gradient.

The method of producing an article of apparel may further comprise: (a) arranging a first insulating layer in the first woven area and (b) arranging a third insulating layer in the third woven area.

This way it is possible to enhance a difference in the properties of the article of apparel in the first woven area and the third woven area, for example differences in air permeability, thermal insulation, and moisture transport.

The first insulating layer may comprise a synthetic filling and the third insulating layer may comprise down feathers. A synthetic filling may be sealed even in a woven fabric with a low weaving density, i.e. a woven fabric with a large distance between adjacent weft or warp yarns. A filling comprising down feathers provides excellent thermal insulation and moisture transport properties but typically requires a higher weaving density. This combination of the first and third insulating layer therefore ensures optimal compatibility with the woven fabric in the first woven area and the third woven area. Either or both fillings may be sealed in compartments in order to localize the filling to a certain area of the article of apparel.

Alternatively, the method of producing an article of apparel may comprise arranging only one insulating layer arranged in the first, second, and third woven areas, wherein the insulating layer may comprise a synthetic filling, or a down feather filling, or a mixture thereof, as described herein.

The third weft density may be at least twice as large as the first weft density. The inventors have studied the differences in heat production and perspiration for different parts of the human body and compared these to the different properties, in particular thermal insulation and moisture transport, effected by a different weft density. The inventors have found that in order to accommodate the different requirements of different parts of the human body, the third weft density should be at least twice as large as the first weft density, preferably five times as large, and for some applications preferably at least ten times as large.

Alternatively, or additionally, the third yarn weight per unit length may be at least twice as large as the first yarn weight per unit length. The inventors have found that in order to accommodate the different requirements of different parts of the human body, the third yarn weight per unit length should be at least twice as large as the first yarn weight per unit length, preferably five times as large, and for some applications preferably at least ten times as large.

The first air permeability may be at least twice as large as the third air permeability. The inventors have found that in order to accommodate the different requirements of different parts of the human body particularly concerning ventilation, the first air permeability should be at least twice as large as the third air permeability, preferably five times as large, and for some applications preferably at least ten times as large.

The article of apparel may be a jacket, a shirt, a jersey, a swim suit, or a vest. The anatomic and athletic requirements vary particularly on the upper body and less so on the lower body. Therefore, it is advantageous if the article of apparel is a garment for the upper body. However, alternatively the article of apparel may be a pair of trousers or shorts, or even a shoe, a boot, or a sock.

The method of producing an article of apparel may further comprise arranging the third woven area in a kidney area. The inventors have found, that a kidney area requires a good level of thermal insulation for comfort and to prevent illness, therefore the third woven area is advantageously arranged in a kidney area.

The method of producing an article of apparel may further comprise arranging the third woven area in a chest area. The inventors have found, that a chest area requires a good level of thermal insulation and needs to offer a good level of wind resistance for comfort and to prevent illness, therefore the third woven area is advantageously arranged in a chest area.

The method of producing an article of apparel may further comprise arranging the first woven area in an upper back area. The inventors have found, that an upper back area requires a good level of ventilation and heat transport, i.e. low thermal insulation for comfort and to prevent overheating of an athlete during exercise, for example running or cycling, during which the upper back area is not generally subjected to much air circulation. Therefore, the first woven area is advantageously arranged in an upper back area.

The method of producing an article of apparel may further comprise arranging the first woven area in a lower front area in order to facilitate a preferable degree of ventilation for the athlete.

The method of producing an article of apparel may further comprise providing at least one yarn with a meltable component and melting the meltable component. Preferably, the meltable material melts at a temperature of less than 100° C., more preferably less than 80° C., in order to prevent damage to the other yarns in the component during heating. For example, one or more yarns may be a melt yarn, sometimes also referred to as a fuse yarn. A melt yarn may have a core with a high melting temperature which is coated with a material with a lower melting temperature. Melting a melt yarn and subsequently allowing the melt yarn to cool down and solidify allows a simple stabilization and consolidation of the article of apparel, which is particularly useful to stabilize the gradient in weaving density. However, it may also be possible that a gradient in weaving density is maintained merely by the friction between the yarns.

The first woven area may comprise a yarn of a first material; the third woven area may comprise a yarn of a third material; and the first material may be different to the third material. Thus, it is possible to further enhance the differences in the properties between the first woven area and third woven area. It is further possible that weaving the second woven area comprises a yarn of a second material and wherein the second material comprises a blend of the first material and the third material that gradually changes from the first material to third material. Thus, it is possible to also enhance the effect of the gradual change in the properties of the article of apparel in the second woven area.

SHORT DESCRIPTION OF THE FIGURES

In the following, exemplary embodiments of the invention are described with reference to the figures. The figures show:

FIG. 1: an exemplary article of apparel according to the present invention.

Figure 2A:
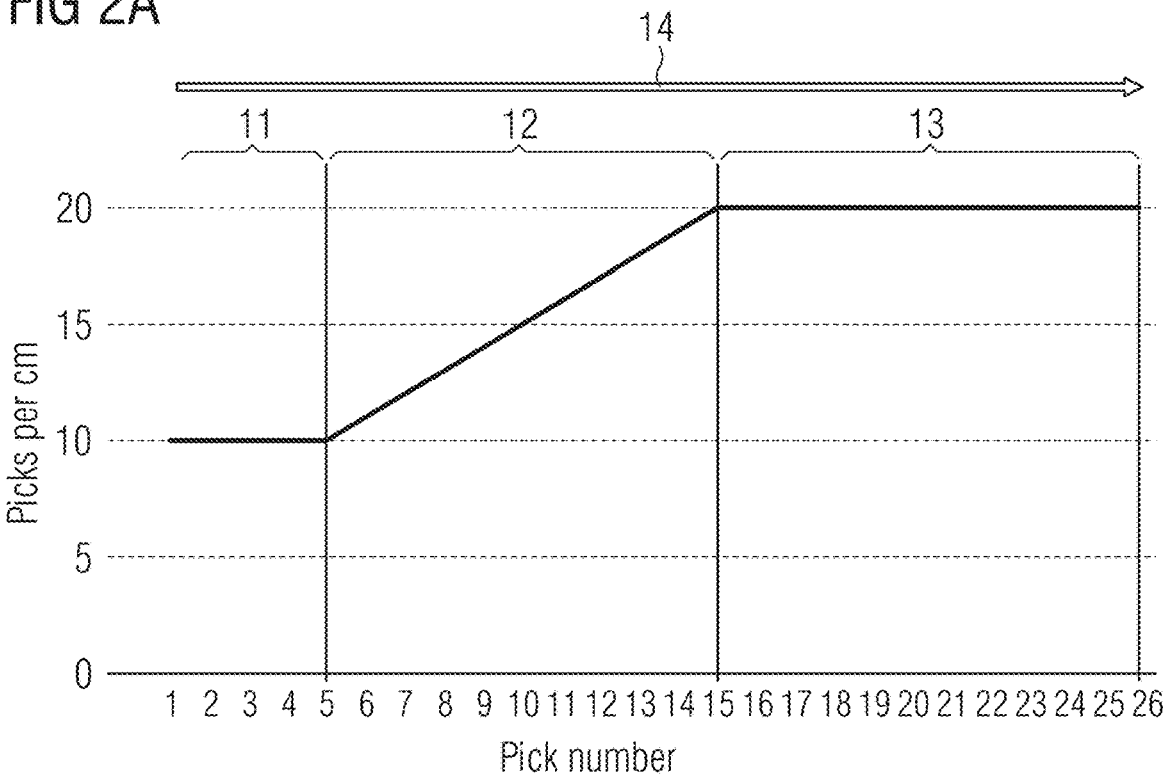

FIG. 2A: a plot showing exemplary weaving density along a cut through the exemplary article of apparel of FIG. 1.

Figure 2B:
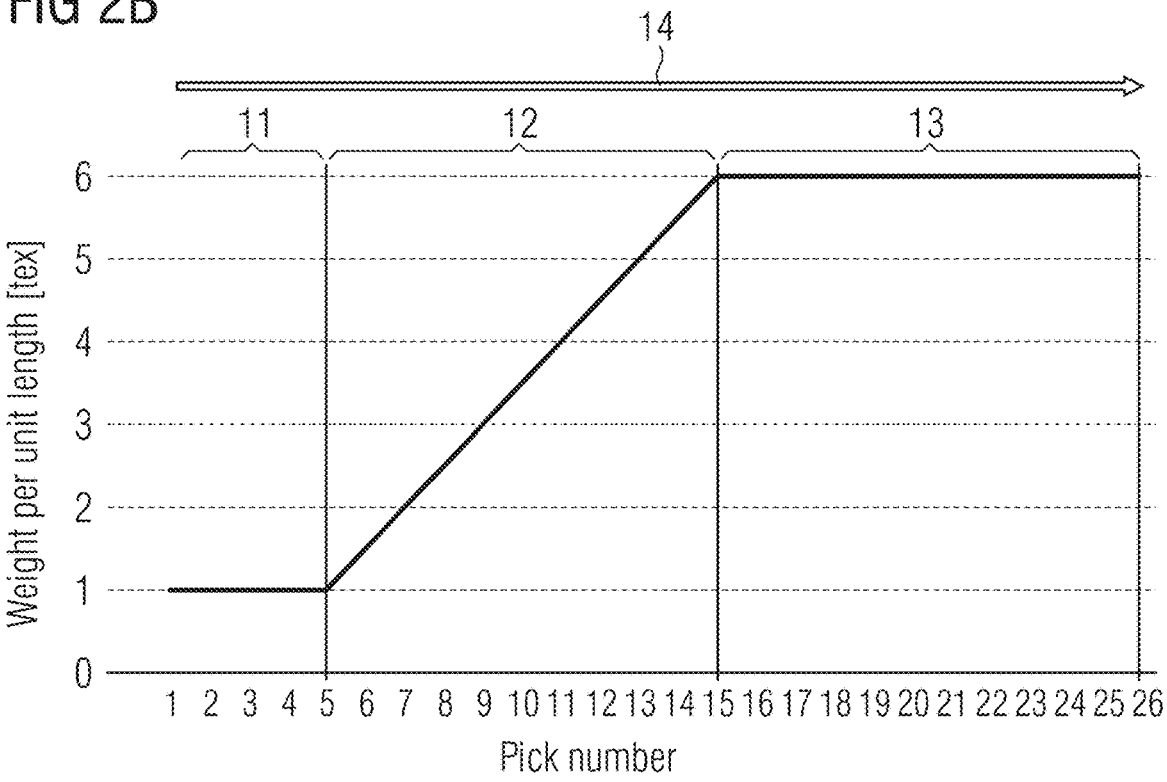

FIG. 2B: a plot showing yarn weight per unit area along a cut through the exemplary article of apparel of FIG. 1.

Figure 2C:
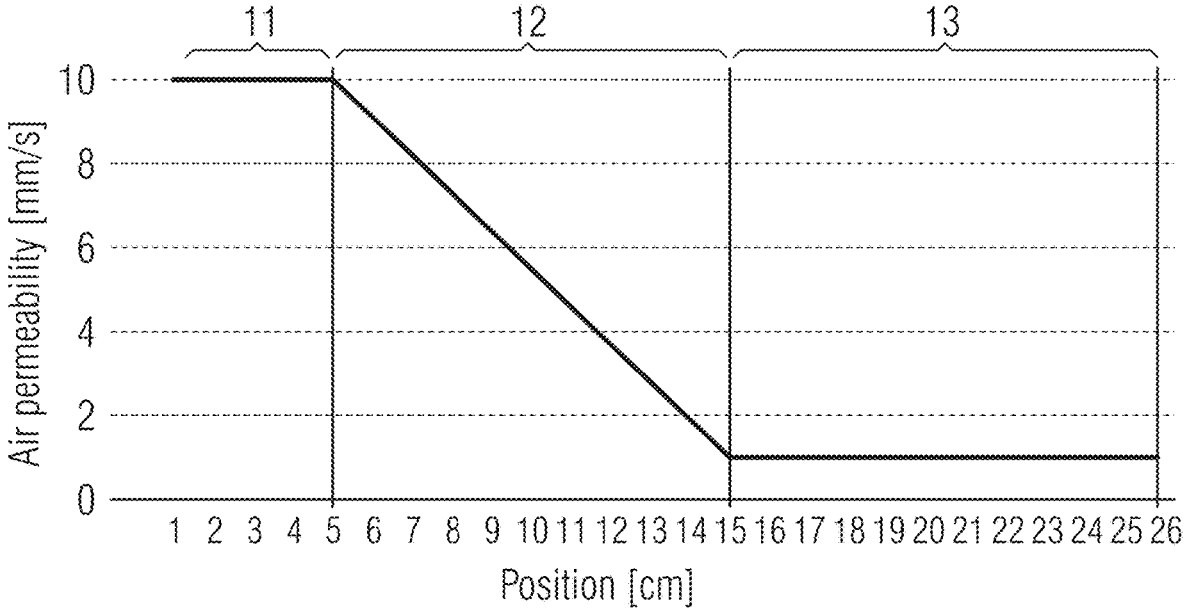

FIG. 2C: a plot showing air permeability along a cut through the exemplary article of apparel of FIG. 1.

Figure 3:
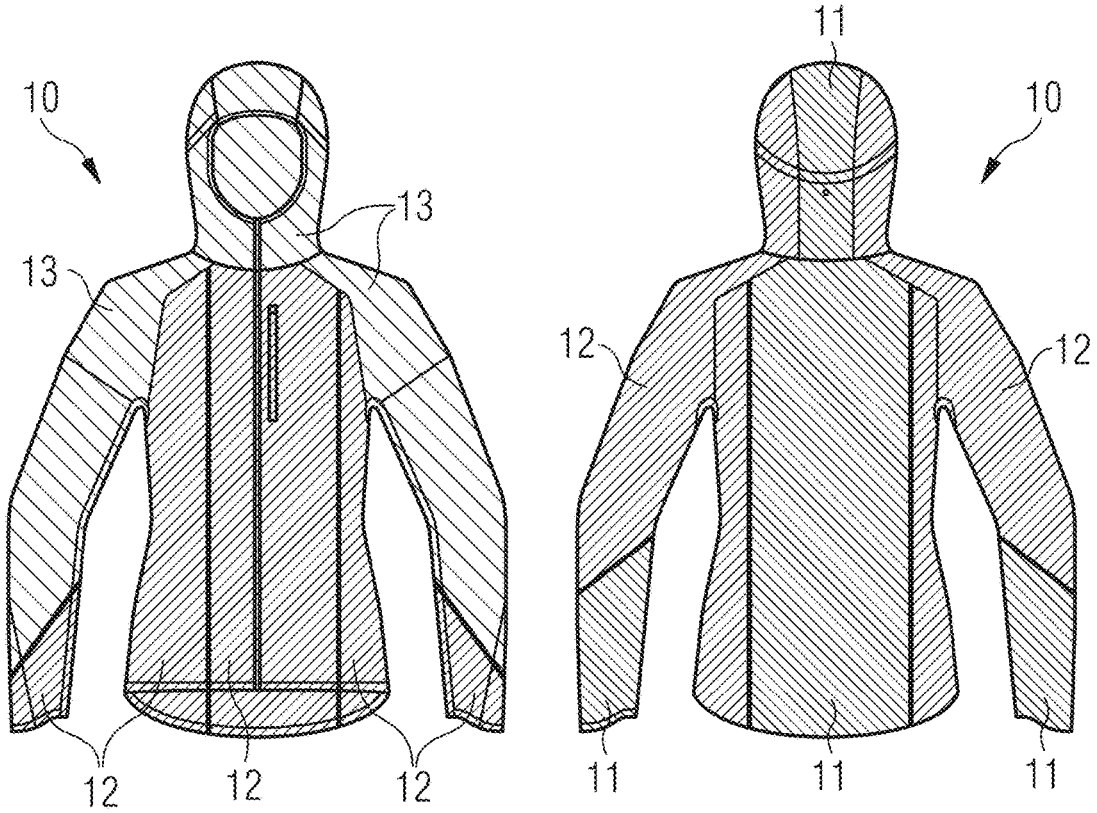

FIG. 3: another exemplary article of apparel according to the present invention.

Figure 4:
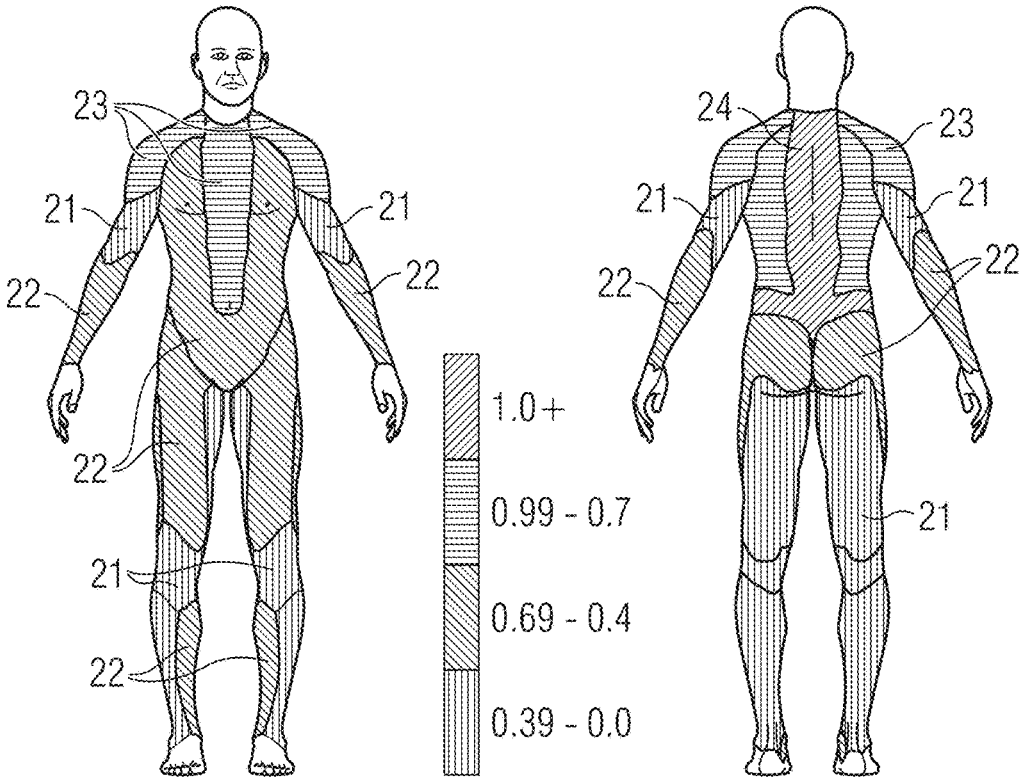

FIG. 4: an exemplary map showing the perspiration of a body of an athlete during physical exercise.

Figure 5:
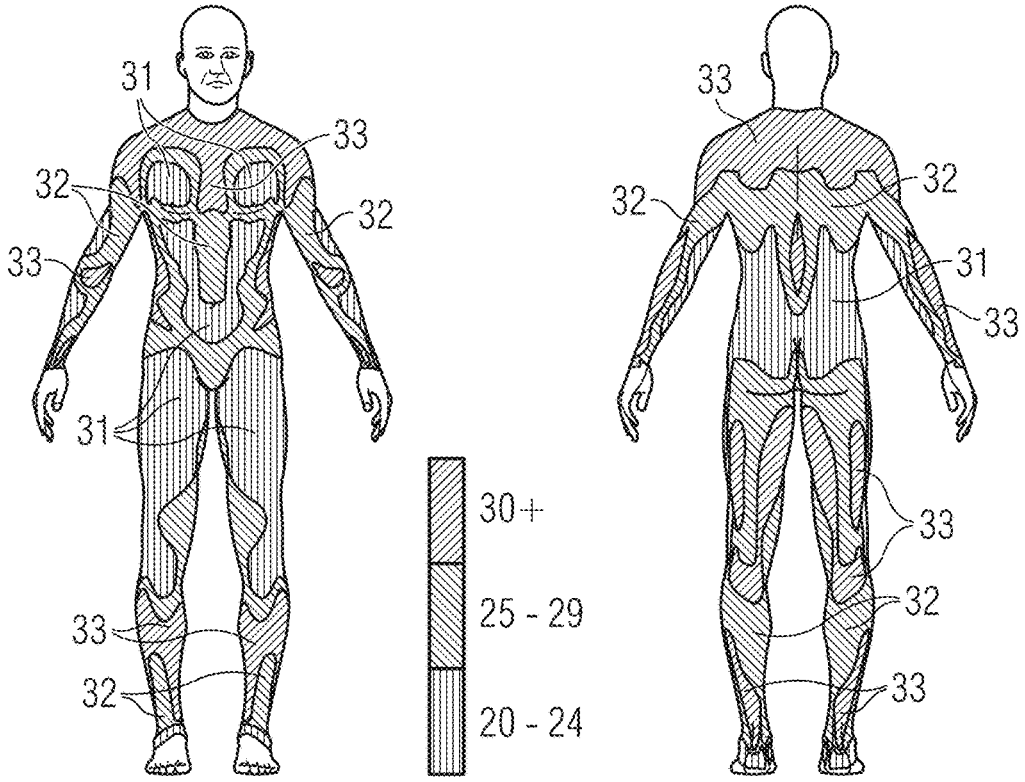

FIG. 5: an exemplary heat map of a body of an athlete during physical exercise.

DETAILED DESCRIPTION OF PREFERRED EMBODIMENTS

In the following only some possible embodiments of the invention are described in detail. It is to be understood that these exemplary embodiments can be modified in a number of ways and combined with each other whenever compatible and that certain features may be omitted in so far as they appear dispensable. While the invention is described primarily with reference to a jacket it is to be understood that the teachings of the present invention apply to any article of apparel, such as a shirt, a jersey, a swim suit, a vest, a pair of trousers or shorts, a shoe, a boot, or a sock.

The figures shown below are for illustrative purposes only and are not to scale.

FIG. 1 shows an exemplary article of apparel 10 according to the present invention, comprising: (a) a first woven area 11, wherein the first woven area 11 comprises a first weaving density and a first yarn weight per unit length; (b) a second woven area 12 arranged adjacent to the first woven area 11, wherein the second woven area 12 comprises a second weaving density and a second yarn weight per unit length; and (c) a third woven area 13 arranged adjacent to the second woven area 12, wherein the third woven area 13 comprises a third weaving density and a third yarn weight per unit length; wherein the second weaving density in the second woven area 12 changes gradually from the first weaving density to the third weaving density; and wherein the second yarn weight per unit length in the second woven area 12 changes gradually from the first yarn weight per unit length to the third yarn weight per unit length.

In this example, both the second weaving density in the second woven area 12 changes gradually from the first weaving density to the third weaving density and the second yarn weight per unit length in the second woven area 12 changes gradually from the first yarn weight per unit length to the third yarn weight per unit length. However, according to the invention, it is also possible that only one of the weaving density or the yarn weight per unit area changes gradually in the second woven area 12.

The exemplary article of apparel 10 is a sports jacket, however, generally the article of apparel 10 may also be for use in leisure or business. The left part of FIG. 1 shows the front of the jacket, while the right part of FIG. 1 shows the back of the jacket.

In this example, the first 11, second 12, and third 13 woven area is at least 5 cm long in any direction along the surface of the article of apparel 10 to ideally match the gradual change of the anatomic and athletic requirements of a wearer.

It is to be understood that the article of apparel 10 may comprise at least one further area (not shown) that comprises a textile, for example a knitted textile or a non-woven textile, or non-textile material, for example a waterproof sheet made from a synthetic material.

The first woven area 11, the second woven area 12, and the third woven area 13 are connected by weaving and are part of one unitary woven fabric. Therefore, a stitching is absent from an interface between the first woven area 11 and the second woven area 12, and an interface between the second woven area 12 and the third woven area 13.

The first woven area 11 comprises a first air permeability, the second woven area 12 comprises a second air permeability, the third woven area 13 comprises a third air permeability, and the second air permeability in the second woven area 12 changes gradually from the first air permeability to the third air permeability.

The air permeability is to be determined for the woven fabric in the first woven area 11, the second woven area 12, and the third woven area 13, itself, irrespective of any additional layers, such as fillings.

In the exemplary embodiment of FIG. 1 the first weaving density is a first weft density; the second weaving density is a second weft density; the third weaving density is a third weft density; and the second weft density in the second woven area 12 changes gradually from the first weft density to the third weft density. In other words, the first, second, and third weaving density may be determined by a first, second, and third number of picks per unit length, for example picks per centimetre or picks per inch, respectively.

The article of apparel 10 further comprises (a) a first insulating layer 15 arranged in the first woven area 11 and (b) a third insulating layer 16 arranged in the third woven area 13. This way it is possible to enhance a difference in the properties of the article of apparel 10 in the first woven area 11 and the second woven area 12, for example differences in air permeability, thermal insulation, and moisture transport.

The first insulating layer comprises a synthetic filling and the third insulating layer comprises down feathers. A synthetic filling may be sealed even in a woven fabric with a low weaving density, i.e. a woven fabric with a large distance between adjacent weft or warp yarns. The inventors have found that there is a strong correspondence between the air permeability and the ability of a woven fabric to seal a filling. For example, for a plain weave pattern, a synthetic filling may be sealed even for an air permeability as large as 50 mm/s (approximately 10 cubic feet per square foot per minute). A filling comprising down feathers provides excellent thermal insulation and moisture transport properties but typically requires a higher weaving density. For example, for a plain weave pattern, a down feather filling may be sealed by a woven fabric with an air permeability of about 15 mm/s (approximately 3 cubic feet per square foot per minute) or less. This combination of the first and third insulating layer therefore ensures optimal compatibility with the woven fabric in the first woven area 11 and the third woven area 13. Both fillings are sealed in compartments in order to localize the fillings to the corresponding area of the article of apparel.

The third weft density is twice as large as the first weft density. Therefore, the third woven area 13 is less air permeable and offers better thermal insulation than the first woven area 11.

The third yarn weight per unit length is six times as large as the first yarn weight per unit length. This enhances the differences in air permeability and thermal insulation provided by the first weft density. In this example, the first air permeability is ten times as large as the third air permeability.

The third woven area 13 is arranged in a kidney area. The inventors have found, that a kidney area requires a good level of thermal insulation for comfort and to prevent illness, therefore the third woven area 13 is advantageously arranged in a kidney area.

The third woven area 13 is also arranged in a chest area. The inventors have found, that a chest area requires a good level of thermal insulation and needs to offer a good level of wind resistance for comfort and to prevent illness, therefore the third woven area 13 is advantageously arranged in a chest area.

The first woven area 11 is also arranged in an upper back area. The inventors have found, that an upper back area requires a good level of ventilation and heat transport, i.e. low thermal insulation for comfort and to prevent overheating of an athlete during exercise, for example running or cycling, during which the upper back area is not generally subjected to much air circulation. Therefore, the first woven area 11 is advantageously arranged in an upper back area.

The first woven area 11 is also arranged in a lower front area and in a lower arm area, in order to facilitate a preferable degree of ventilation for the athlete.

The second woven area 12 is arranged in-between the first woven area 11 and the third woven area 13.

The article of apparel 10 further comprises at least one yarn, which comprises a meltable component. In this example, the meltable material melts at a temperature of less than 100° C. in order to prevent damage to the other yarns in the component during heating. In this example, the article of apparel 10 comprises a melt yarn, sometimes also referred to as a fuse yarn. The melt yarn has a core with a high melting temperature which is coated with a material with a lower melting temperature. The melt yarn allows a simple stabilization and consolidation of the article of apparel 10, which is particularly useful to stabilize the gradient in weaving density.

The first woven area 11 comprises a yarn of a first material, in this example high-tenacity polyester. The third woven area 13 comprises a yarn of a third material, in this example heather yarn. Thus, the first material is different from the third material.

FIG. 2A shows an exemplary weft density, measured in picks per cm along the exemplary cut indicated with reference numeral 14 in FIG. 1. The vertical axis shows picks per centimetre and the horizontal axis indicates the pick number, i.e. the weft yarn number. In the first woven area 11, the weft density is 10 picks per centimetre. In the third woven area 13, the weft density is 20 picks per centimetre. The third weft density is therefore at least twice as large as the first weft density. In the second woven area 12, the weft density changes gradually from 10 picks per centimetre to 20 picks per centimetre.

In this example, the number of picks per centimetre increases strictly monotonically and linearly between pick number 5 and pick number 15. However, it is to be understood that the number of picks per centimetre may not increase strictly monotonically, or even monotonically between pick number 5 and pick number 15. It is also not necessary that the number of picks per centimetre increases linearly in the second woven area 12. In this example, the number of picks per centimetre increases between each adjacent pair of picks in the second woven area 12, in other words with each "step" in the second woven area 12. However, it is also possible that the number of picks per centimetre increases with a different periodicity, for example at every other pick, every third pick, or every fifth pick, or in a non-periodic manner.

In this example, the second woven area 12 comprises ten changes of the second weaving density. The greater the number of changes, the finer the "granularity" of the gradient and hence the better the matching of gradual changes in the anatomic and athletic requirements.

In this example, gradually changing the weft density in the second woven area 12 comprises gradually changing the speed of a take-up roller. The method of production comprises a loom and a take-up roller may be any device configured to pull the woven fabric out of the loom. In this example, the take-up roller speed in the first woven area 11 is twice as large as the take-up roller speed in the third woven area 13, but the time between weft insertions is kept the same in the first 11, second 12, and third 13 woven area. This results in the weft density as shown in FIG. 2A.

A visual analysis system comprising a camera was used to monitor the weft and/or warp density in real time. A high contrast image was processed with a computer to obtain the number of weft yarns, or picks per cm. This information was used to provide direct feedback to adjust the speed of the take-up roller in order to achieve the selected target weft density and weft density gradient.

FIG. 2B shows the weight per unit area of the yarn in the first, second, and third woven area 13 measured in tex. One tex corresponds to a mass of 1 g per 1000 m of yarn. One tex corresponds to 9 dernier. In this example, the first weight per unit length in the first woven area 11 is 1 tex, the third weight per unit length in the third woven area 13 is 6 tex and the second weight per unit area in the second woven area 12 gradually increases from 1 tex to 6 tex. Therefore, the third yarn weight per unit length is at least twice as large as the first yarn weight per unit length.

In this example, the second yarn weight per unit length increases strictly monotonically and linearly between pick number 5 and pick number 15. However, it is to be understood that the second yarn weight per unit length may not increase strictly monotonically, or even monotonically between pick number 5 and pick number 15. It is also not necessary that the second yarn weight per unit length increases linearly in the second woven area 12. In this example, the second yarn weight per unit length increases between each adjacent pair of picks in the second woven area 12, in other words with each "step" in the second woven area 12. However, it is also possible that the second yarn weight per unit length increases with a different periodicity, for example at every other pick, every third pick, or every fifth pick, or in a non-periodic manner.

In this example, the second woven area 12 comprises ten changes of the second yarn weight per unit length. The greater the number of changes, the finer the "granularity" of the gradient and hence the better the matching of gradual changes in the anatomic and athletic requirements.

FIG. 2C shows the air permeability measured in mm/s which is the same as $1/m^2/s$ for a cut along the surface of the article of apparel 10 shown in FIG. 1. An exemplary protocol for measuring the air permeability is as follows:

The general principle is that the rate of flow of air passing through a fabric is measured at a given pressure difference across the fabric test area over a given time period.

A suitable air permeability measurement equipment comprises:

- a test head that provides a circular clamping area of 38 $cm^2$
- a clamping system to secure the test specimens under a force of 50N±5N to the test head
- a guard ring to prevent leakage
- a pressure gauge or manometer connected to the test head to indicate pressure drop across the test area
- a suitable means for drawing steady flow rate of air through the specimen and to adjust flow rate to produce a pressure drop
- a flow-meter to measure the air velocity through the test area in mm/s
- a calibration plate with known air permeability to verify the equipment The fabric may be tested without cutting specimens but areas should be tested that are free from creases and folds. A minimum of 5 readings across the full width of fabric are required. The fabric is conditioned for a minimum of 4 hours in a conditioned atmosphere of 20±2° C. and 65±2% relative humidity before testing. The measurement must be carried out in the conditioned laboratory. The measurement is carried out on the test on the face side of the fabric. The pressure differential is 100 Pa.

The following steps need to be performed:

1. Calibrate the equipment before commencing the test
2. Mount a specimen in the circular specimen holder
3. The fabric should be placed with coated side face down (if the face is coated).
4. Start the suction fan to force air through the test specimen and adjust the flow of air until a pressure drop is achieved across the test area
5. Record the air flow after at least 1 min. or until steady conditions are achieved
6. Repeat steps 2-5 for the remaining 4 specimens Although the air permeability will therefore be an average air permeability averaged over the clamping area, in this case 38 $cm^2$, it is still possible to determine a gradient on a smaller scale by displacing the clamping area, for example by 1 cm at a time. The skilled person may further apply known techniques of deconvolution to obtain a measurement of air permeability against position on a smaller scale than the scale of the clamping area.

Although the described measurement equipment and protocol would be suitable for determining the air permeability, any other suitable method and apparatus may be used. In particular since aspects of the present invention relate to relative differences in air permeability, these relative differences may still be asserted even for different measurement equipment and/or protocols.

The air permeability shown in FIG. 2C is shown "as measured" by the above protocol without deconvolution as a function of position measured in centimetres. The air permeability was measured only for the woven fabric of the first 11, second 12, and third 13 woven area of the article of apparel 10, excluding the filling, i.e. the filling was removed for the measurement.

The air permeability is 10 mm/s in the first woven area 11 and 1 mm/s in the third woven area 13. The air permeability decreases gradually in the second woven area 12 from 10 mm/s to 1 mm/s. The first air permeability is therefore at least twice as large as the third air permeability.

In this example, the second air permeability decreases strictly monotonically and linearly between position 5 cm and position 15 cm. However, it is to be understood that the second air permeability may not decrease strictly monotonically, or even monotonically between the position 5 cm and the position 15 cm. It is also not necessary that the second air permeability increases linearly in the second woven area 12.

FIG. 3 shows an exemplary article of apparel 10 according to the present invention, comprising: (a) a first woven area 11, wherein the first woven area 11 comprises a first weaving density and a first yarn weight per unit length; (b) a second woven area 12 arranged adjacent to the first woven area 11, wherein the second woven area 12 comprises a second weaving density and a second yarn weight per unit length; and (c) a third woven area 13 arranged adjacent to the second woven area 12, wherein the third woven area 13 comprises a third weaving density and a third yarn weight per unit length; wherein the second weaving density in the second woven area 12 changes gradually from the first weaving density to the third weaving density.

In this example, only the second weaving density in the second woven area 12 changes gradually from the first weaving density to the third weaving density. The second yarn weight per unit length in the second woven area 12 is constant.

The exemplary article of apparel 10 is a sports jacket, however, generally the article of apparel 10 may also be for use in leisure or business. The left part of FIG. 3 shows the front of the jacket, while the right part of FIG. 3 shows the back of the jacket.

In this example, the first, second, and third woven area 13 is at least 10 cm long in any direction along the surface of the article of apparel 10 to ideally match the gradual change of the anatomic and athletic requirements of a wearer.

It is to be understood that the article of apparel 10 may comprise at least one further area (not shown) that comprises a textile, for example a knitted textile or a non-woven textile, or non-textile material, for example a waterproof sheet made from a synthetic material.

The first woven area 11, the second woven area 12, and the third woven area 13 are connected by weaving and are part of one unitary woven fabric. Therefore, a stitching is absent from an interface between the first woven area 11 and the second woven area 12, and an interface between the second woven area 12 and the third woven area 13.

The first woven area 11 comprises a first air permeability, the second woven area 12 comprises a second air permeability, the third woven area 13 comprises a third air permeability, and the second air permeability in the second woven area 12 changes gradually from the first air permeability to the third air permeability.

The air permeability is to be determined for the woven fabric in the first woven area 11, the second woven area 12, and the third woven area 13, itself, irrespective of any additional layers, such as fillings.

In this exemplary embodiment the first weaving density is a first weft density; the second weaving density is a second weft density; the third weaving density is a third weft density; and the second weft density in the second woven area 12 changes gradually from the first weft density to the third weft density.

The third weft density is five times as large as the first weft density. Therefore, the third woven area 13 is less air permeable and offers better thermal insulation than the first woven area 11. In this example, the first air permeability is five times as large as the third air permeability.

The third woven area 13 is also arranged in a chest area. The inventors have found, that a chest area requires a good level of thermal insulation and needs to offer a good level of wind resistance for comfort and to prevent illness, therefore the third woven area 13 is advantageously arranged in a chest area.

The first woven area 11 is arranged in an upper and lower back area. The inventors have found, that for some applications, such as cycling, the upper and lower back area require a good level of ventilation and heat transport, i.e. low thermal insulation for comfort and to prevent overheating of an athlete.

The first woven area 11 is also arranged in a lower arm area to allow ventilation. The second woven area 12 is arranged in-between the first woven area 11 and the third woven area 13, for example on the lateral sides of the jacket and the backside of the upper arm.

FIG. 4 shows an exemplary perspiration map of the athlete during exercise. FIG. 5 shows an exemplary heat map of the body of an athlete during exercise.

The inventors have studied the local differences in heat production and perspiration for different parts of the human body and in order to engineer an apparel with ideal "body mapping" properties to takes account of the anatomic and athletic requirements of an athlete.

FIG. 4 shows an exemplary relative scale of perspiration of an athlete during exercise. In the areas indicated with reference numeral 24, very high levels of perspiration are observed. These areas 24 are located, for example, in a central back region. In the areas indicated with reference numeral 23, high levels of perspiration are observed. These areas 23 are located, for example, in a medial chest and abdominal area, a shoulder area, and a lateral back area. In the areas indicated with reference numeral 22, medium levels of perspiration are observed. These areas are located, for example, in a lower arm area, a lateral chest and abdominal area, the front of the thigh, and a medial calf area. In the areas indicated with reference numeral 21, lower levels of perspiration are observed. These areas 21 are located in a biceps area, around the back of the legs and round a lateral area of the lower leg. It is also important to understand, that this distribution is shown for four levels of perspiration for illustration purposes only. The distribution of perspiration, and therefore the anatomic and athletic requirements of an athlete during exercise, vary gradually from one region to another.

Generally, it is therefore preferable to arrange a first woven area with high air permeability for good ventilation properties around very high perspiration areas 24 and a third woven area with lower air permeability around low perspiration areas 21. The second woven area is then preferably arranged in between the first and third woven area in proximity to the high 23 and medium 22 perspiration areas. It should be noted, however, that external factors, for example wind-chill during running or cycling also affect the preferred arrangement of the first, second, and third woven areas.

The measured skin surface temperature of an athlete during exercise is shown in FIG. 5. In the areas indicated with reference numeral 33, the skin surface temperature of the athlete is 30° C. or more. These hot areas 33 are located, for example, in a neck and shoulder portion of the athlete, a lower arm portion, in particular around the tendon of the brachialis muscle in the elbow region, around the semitendinosus muscle on the back of the upper leg, and around the shin. In the areas indicated with reference numeral 32, the skin surface temperature of the athlete is between 25 and 29° C. These warm areas 32 are located, for example, around the medial abdominal muscle (musculus rectus abdominis), the chest, and a middle region of the back located around the latissimus dorsi muscle. In the areas indicated with reference numeral 31, the skin temperature of the athlete is between 20 and 24° C. These cold areas 31 are located, for example, in a kidney area in the lower back, around the lateral abdominal muscles, and a front thigh region around the rectus femoris muscle. Naturally, the temperature distribution on the surface of the skin of an athlete depends on the type of exercise as well as on the athlete. It is also important to understand, that this distribution is shown for three levels of skin surface temperature for illustration purposes only. The distribution of temperatures, and therefore the anatomic and athletic requirements of an athlete during exercise, vary gradually from one region to another.

Generally, it is therefore preferable to arrange a first woven area with high air permeability and low thermal insulation around the hot areas 33 and a third woven area with lower air permeability and better thermal insulation around the cold areas 31. The second woven area is then preferably arranged in between the first and third woven area in proximity to the warm areas 32. It should be noted, however, that external factors, for example wind-chill during running or cycling also affect the preferred arrangement of the first, second, and third woven areas.

REFERENCE SIGNS

10: article of apparel
11: first woven area
12: second woven area
13: third woven area
21: area with low level of perspiration
22: area with medium level of perspiration
23: area with high level of perspiration
24: area with very high level of perspiration
31: cold area
32: warm area
33: hot area

What is claimed is:

1. An article of apparel comprising:
a first yarn of a first yarn material;
a second yarn of a second yarn material;
a third yarn of a third yarn material,
wherein the second yarn material comprises a blend of the first yarn material and the third yarn material;
a first woven area comprising the first yarn,
wherein the first woven area comprises a first weaving density and a first yarn weight per unit length,
wherein a first insulating layer is sealed within the first woven area, and
wherein the first insulating layer comprises a first insulating material;
a second woven area arranged adjacent to the first woven area,
wherein the second woven area comprises a second weaving density and a second yarn weight per unit length; and
a third woven area arranged adjacent to the second woven area and comprising the third yarn,
wherein the third woven area comprises a third weaving density and a third yarn weight per unit length,
wherein a second insulating layer is sealed within the third woven area, and
wherein the second insulating layer comprises a second insulating material different than the first insulating material,
wherein the second woven area comprises the second yarn,
wherein the second insulating layer provides greater thermal insulation than the first insulating layer,
wherein the first woven area comprises a first air permeability and the third woven area comprises a third air permeability, the first air permeability being greater than the third air permeability, and
wherein the second weaving density in the second woven area changes gradually from the first weaving density to, and/or
wherein the second yarn weight per unit length in the second woven area changes gradually from the first yarn weight per unit length to the third yarn weight per unit length.

2. The article of apparel according to claim 1, wherein the first woven area, the second woven area, and the third woven area are connected by weaving and are part of one unitary woven fabric.

3. The article of apparel according to claim 1, wherein:
the second woven area comprises a second air permeability; and
the second air permeability in the second woven area changes gradually from the first air permeability to the third air permeability.

4. The article of apparel according to claim 1, wherein:
the first weaving density is a first weft density;
the second weaving density is a second weft density;
the third weaving density is a third weft density; and
the second weft density in the second woven area changes gradually from the first weft density to the third weft density.

5. The article of apparel according to claim 1, wherein the first insulating layer comprises a synthetic filling and the second insulating layer comprises down feathers.

6. The article of apparel according to claim 4, wherein the third weft density is at least twice as large as the first weft density.

7. The article of apparel according to claim 1, wherein the third yarn weight per unit length is at least twice as large as the first yarn weight per unit length.

8. The article of apparel according to claim 1, wherein the first air permeability is at least twice as large as the third air permeability.

9. The article of apparel according to claim 1, wherein the article of apparel is a jacket, a shirt, a jersey, a swim suit or a vest.

10. The article of apparel according to claim 9, wherein the third woven area is configured to be arranged in a kidney area of a wearer.

11. The article of apparel according to claim 9, wherein the third woven area is configured to be arranged in a chest area of a wearer.

12. The article of apparel according to claim 9, wherein the first woven area is configured to be arranged in an upper back area of a wearer.

13. The article of apparel according to claim 9, wherein the first woven area is configured to be arranged in a lower front area of a wearer.

14. The article of apparel according to claim 1, further comprising at least one yarn, which comprises a meltable component.

15. The article of apparel according to claim 1, wherein the first insulating layer comprises a mixture of a synthetic filling and down feathers.

16. The article of apparel according to claim 1, wherein first woven area and the second woven area are configured to be arranged in a lower arm area of a wearer.

17. The article of apparel according to claim 1, wherein the first woven area, the second woven area, and the third woven are at least 5 centimeters long.

18. The article of apparel according to claim 1, the third weaving density is greater than the first weaving density, and the first air permeability is greater than the third air permeability.

19. An article of apparel comprising:

two arm openings;

an upper back area arranged between the two arm openings;

a first woven area arranged in the upper back area, wherein the first woven area comprises a first weaving density and a first yarn weight per unit length, wherein a first insulating layer is arranged in the first woven area and wherein the first insulating layer comprises a synthetic filling;

a second woven area arranged adjacent to the first woven area, wherein the second woven area comprises a second weaving density and a second yarn weight per unit length; and a third woven area arranged adjacent to the second woven area, wherein the third woven area comprises a third weaving density and a third yarn weight per unit length, wherein a second insulating layer is arranged in the third woven area, and wherein the second insulating layer comprises down feathers, wherein the second woven area comprises an insulation transition between the first woven area and the third woven area, the transition comprising a portion of the first insulating layer and a portion of the second insulating layer, wherein the first woven area comprises a first air permeability and the third woven area comprises a third air permeability, the first air permeability being greater than the third air permeability, and wherein the second weaving density in the second woven area changes gradually from the first weaving density to the third weaving density, and/or wherein the second yarn weight per unit length in the second woven area changes gradually from the first yarn weight per unit length to the third yarn weight per unit length, wherein the third yarn weight per unit length is at least twice as large as the first yarn weight per unit length.

* * * * *